US007874946B2

(12) United States Patent
Smith

(10) Patent No.: US 7,874,946 B2
(45) Date of Patent: Jan. 25, 2011

(54) BASEBALL BAT WITH MULTIPLE REINFORCING BEAMS

(75) Inventor: Chuck Smith, Gallatin, TN (US)

(73) Assignee: Mattingly Hitting Products, Inc., Shelton, CT (US)

( * ) Notice: Subject to any disclaimer, the term of this patent is extended or adjusted under 35 U.S.C. 154(b) by 0 days.

(21) Appl. No.: 12/458,901

(22) Filed: Jul. 27, 2009

(65) Prior Publication Data

US 2010/0087282 A1 Apr. 8, 2010

Related U.S. Application Data

(60) Provisional application No. 61/136,823, filed on Oct. 7, 2008.

(51) Int. Cl.
*A63B 59/06* (2006.01)

(52) U.S. Cl. ..... 473/567; 473/566

(58) Field of Classification Search ..... 473/457, 473/519, 520, 564–568
See application file for complete search history.

(56) References Cited

U.S. PATENT DOCUMENTS

| | | | | |
|---|---|---|---|---|
| 2,340,156 | A * | 1/1944 | Taylor et al. | 473/566 |
| 5,150,897 | A | 9/1992 | Wortman | |
| 5,303,917 | A * | 4/1994 | Uke | 473/567 |
| 5,759,113 | A * | 6/1998 | Lai et al. | 473/321 |
| 5,766,104 | A | 6/1998 | Albarelli, Jr. | |
| 5,785,614 | A | 7/1998 | MacKay, Jr. | |
| 6,176,795 | B1 * | 1/2001 | Schullstrom | 473/566 |
| 6,334,825 | B1 * | 1/2002 | Buiatti | 473/566 |
| 6,612,945 | B1 | 9/2003 | Anderson | |
| 6,899,648 | B2 * | 5/2005 | Chang | 473/564 |
| 7,044,871 | B2 * | 5/2006 | Sutherland et al. | 473/564 |
| 7,207,907 | B2 | 4/2007 | Guenther et al. | |
| 7,232,387 | B1 * | 6/2007 | Heald et al. | 473/566 |
| 7,344,461 | B2 * | 3/2008 | Van Nguyen | 473/567 |
| 7,361,106 | B1 * | 4/2008 | Vacek et al. | 473/566 |
| 7,749,114 | B2 * | 7/2010 | Thouin | 473/520 |
| 2004/0053716 | A1 * | 3/2004 | Wu | 473/564 |
| 2004/0166970 | A1 * | 8/2004 | Sutherland | 473/567 |
| 2005/0202908 | A1 * | 9/2005 | Haynes | 473/564 |
| 2007/0202973 | A1 | 8/2007 | Van Nguyen | |
| 2007/0254752 | A1 | 11/2007 | Sutherland et al. | |
| 2008/0070726 | A1 * | 3/2008 | Watari et al. | 473/566 |

FOREIGN PATENT DOCUMENTS

| | | | |
|---|---|---|---|
| JP | 05015624 A | * | 1/1993 |
| JP | 07088213 A | * | 4/1995 |

* cited by examiner

*Primary Examiner*—Mark S Graham
(74) *Attorney, Agent, or Firm*—Welsh Flaxman & Gitler LLC

(57) ABSTRACT

A bat for limiting the maximum barrel response at high impact speeds while minimizing the dampening performance at low impact speeds includes a plurality of separate longitudinal beams extending from the end of the bat to the tapered portion of the bat. These beams, as well as the tapered portion and a handle, are constructed from a composite material, such as fiber reinforced plastic. An external sleeve is then provided around the barrel portion of the bat. The external sleeve is secured around the barrel of the bat using a snap-fit end cap.

11 Claims, 11 Drawing Sheets

Typical Ball Impact on Round FRP Tubular Barrel Structure

BASEBALL BAT WITH MULTIPLE REINFORCING BEAMS

CROSS-REFERENCE TO APPLICATIONS

The present application claims priority of U.S. provisional patent application Ser. No. 61/136,823, filed on Oct. 7, 2008, the subject matter contained therein being incorporated by reference.

FIELD OF THE INVENTION

The present invention is generally related to the field of baseball and softball and more specifically to a baseball or softball bat used in those sports.

BACKGROUND OF THE INVENTION

Baseball and softball players continually search for better bats to improve their hitting performance. Bat performance is generally based upon length, weight, moment of inertia (MOI) and impact response during contact with the ball. Manufacturers have made attempts to improve the impact response during contact with the ball using a variety of constructions of materials. Unfortunately, each of these prior attempts has various shortcomings.

As manufacturers have improved bats, various regulatory bodies that administer or organize baseball or softball games have placed restrictions on bat performance and configuration. In general, these rules limit the maximum rebound speed of a ball from the barrel portion of the bat. In order to limit the maximum response of the bat, manufacturers have modified their designs to dampen the response to all impacts. In other words, these designs reduce the responsiveness of the bat at both low impact speeds as well as high impact speeds. Typically, this is done by adding material to the thickness of the barrel portion of the bat to increase the hoop stiffness. This results in hindering the hitting performance of less skilled players in an effort to control the maximum rebound speed generated by the best players.

Bat rebound performance is generally maximized at a narrow width of the barrel commonly referred to as the "sweet spot." The prior art includes several attempts to produce a bat with reduced performance at the sweet spot. The intent to these designs has been to level the impact response along a greater width of the barrel, effectively widening the perceived "sweet spot." These attempts have several shortfalls. For example, U.S. Pat. No. 6,949,038, issued to Fritzke, discloses increasing the wall thickness of the barrel near the sweet spot. This is accomplished, for example, by including an insert 22, as illustrated in FIG. 4, having first and second tubular wall transition regions 36 and 38, as well as an intermediate tubular region 40, having an increased thickness. Additionally, as illustrated with respect to FIG. 7, an intermediate tubular region 140 provided on the outside surface of the bat would have an increased thickness. As can be appreciated, the added thickness of the insert or the outer portion of the bat would add additional weight and create stress concentrations at each end of the thicker regions.

In recent years, many bat manufacturers have begun to produce bats using fiber reinforced plastic (FRP) materials. For example, the patent application publication to Van Nguyen, uses a bat body made from a composite material, such as fiberglass, carbon fibers, or a combination of glass and carbon fibers. The use of FRP materials has allowed manufacturers to independently tailor the stiffness characteristics of each portion of the bat. For example, using FRP materials would allow manufacturers to make the handle quite stiff, resulting in less bending, while allowing the barrel portion to be more flexible in the radial or "hoop" direction. However, current approaches to using FRP materials in bats have resulted in a record of poor durability. While FRP materials are quite strong in tension, they are relatively weak in compression. During impact with a ball, the primary forces on the surface of the bat barrel are compressive. For this reason, cracking in the barrel portion of current FRP bats is quite common.

Consequently, there is a need to provide an improved bat which would meet regulation standards for maximum barrel response with less dampening at slower speed impacts. The improved bat would use FRP materials in a way which optimizes their benefits, but avoids the durability issues of existing products.

Additionally, there is a need to produce a bat having a more consistent impact response along the length of the barrel than conventional bats without the increased weight or the creation of stress concentrations, as described in prior art references.

SUMMARY OF THE INVENTION

The deficiencies of the prior art are addressed by the present invention, which is directed to a baseball or softball bat limiting the maximum barrel response at high impact speeds, while minimizing the dampening of performance at lower impact speeds. Such a design will provide better performance for nearly all players, but will still limit maximum-batted ball speeds to meet safety regulations. In addition, the design of the present invention would utilize the benefits of FRP materials, but with improved durability over existing designs on the market.

A standard baseball or softball bat generally comprises a barrel portion, a handle portion and a tapered transition portion provided between the handle portion and the barrel portion. The deficiencies of the prior art are addressed by producing a bat constructed from FRP materials utilizing a plurality of longitudinal beams extending from the top end of the barrel portion and terminating at the tapered transition portion. In another embodiment, one or more of the beams would extend into the tapered transition portion. An external sleeve would be secured around the barrel portion, and could extend for a distance into the tapered transition portion. Various geometries of the beams would be used to alter the maximum barrel response at high impact speeds while minimizing the dampening performance at lower impact speeds. An end cap would be used to secure the external sleeve to the barrel portion as will be subsequently explained.

These and other objects of the present invention will be explained in detail with respect to the following detailed description, when viewed with respect to the accompanying drawings, wherein like reference numerals refer to like parts.

DETAILED DESCRIPTION OF THE PREFERRED EMBODIMENT

Figure 1:
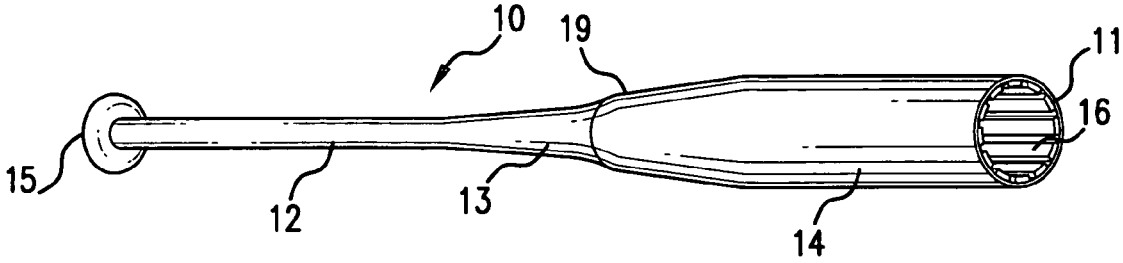
FIG. 1 is a perspective view of the bat according to the present invention.
Figure 2:
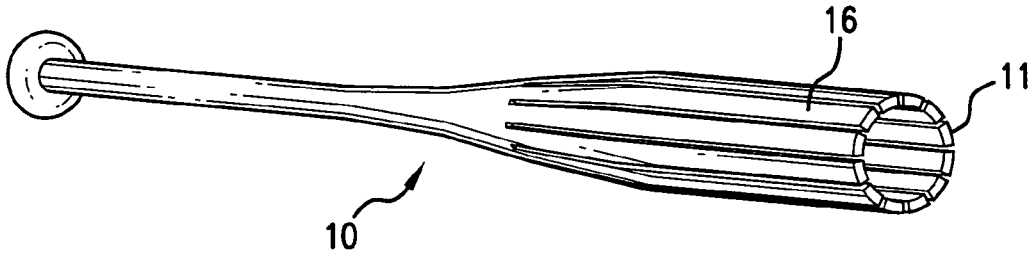
FIG. 2 is a perspective view of the bat according to the present invention, with the sleeve removed.
Figure 3:
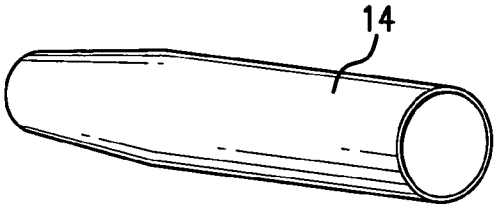
FIG. 3 is a perspective view of the sleeve.
Figure 4:
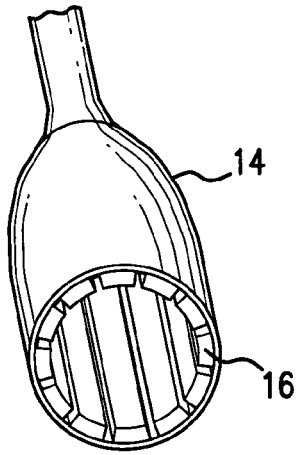
FIG. 4 is a perspective view of the barrel portion of the present invention.
Figure 5:
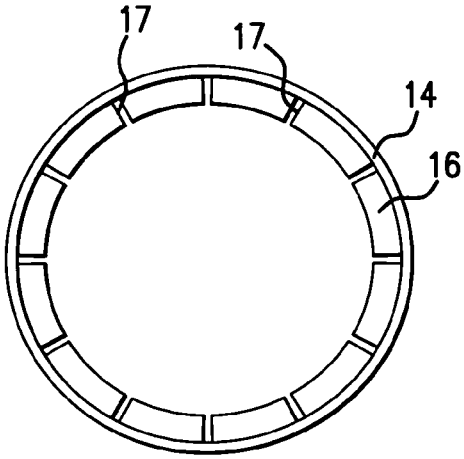
FIG. 5 is an end view of the beams of the present invention.

As illustrated with respect to FIGS. 1-4, a bat 10 includes a handle 12 connected to a barrel 11 through a tapered portion 13. A knob 15 is provided at the end of the handle 12. As can be appreciated, the barrel 11 is used to strike a baseball or softball. As particularly shown in FIG. 2, the barrel 11 is provided with a plurality of beams 16 longitudinally extending from the top of the barrel 11 and terminating to the beginning of the tapered portion 13. As illustrated, the beams 16 would extend around the entire circumference of the barrel 11, which is hollow. The handle 12, the tapered portion 13, as well as the barrel 11, including the beams 16, would be manufactured from fiber-reinforced plastic (FRP) materials. As particularly shown in FIGS. 1, 3 and 4, an external, cylindrically shaped sleeve 14, with a tapered end portion 19, is provided around the barrel portion 11 and particularly around the beams 16. Although not shown in FIGS. 1-4, an end cap is provided at the barrel end of the bat to secure the sleeve around the barrel. This external sleeve 14 can be constructed of metal, such as aluminum, titanium, steel or can be constructed from FRP. As will subsequently explained, the external sleeve 14 is secured to the bat 10 using adhesive, mechanical bonding, or a combination of the two. As shown in FIG. 4, and as illustrated with respect to FIG. 5, when viewed in a neutral state, the beams 16 forming the barrel portion 11 of the bat are evenly spaced about the circumference of the barrel 11. Each of the beams 16 are equal in length and are spaced apart from another at 17 prior to the bat striking a ball.

Figure 6:
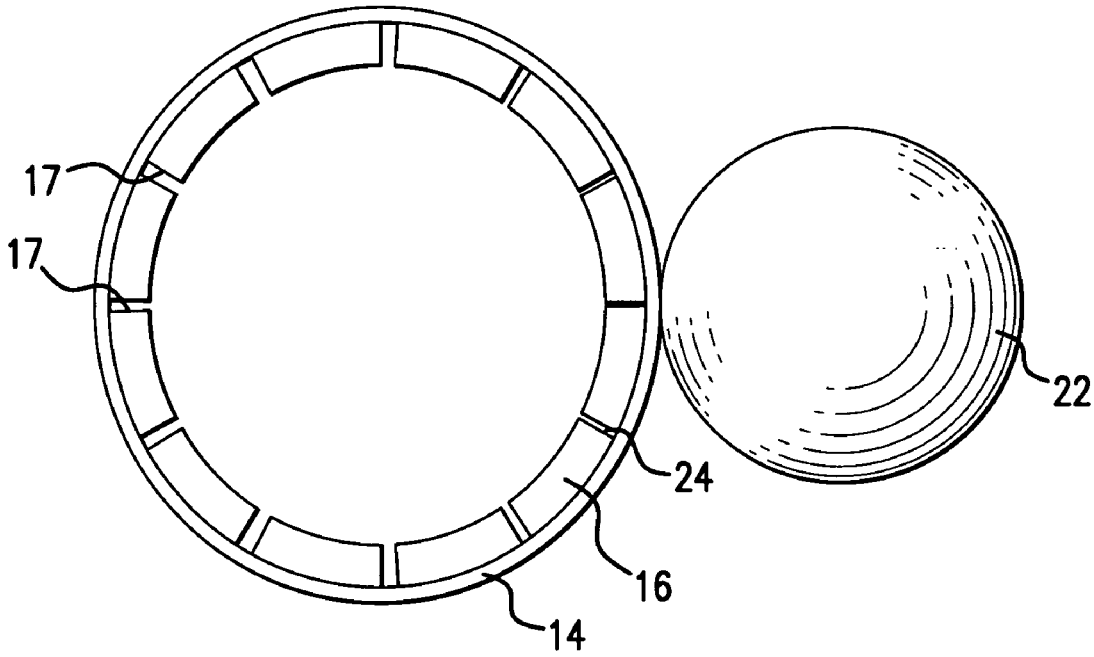
FIG. 6 is a graphical rendition of a ball hitting the bat according to the present invention at low speeds.
Figure 7:
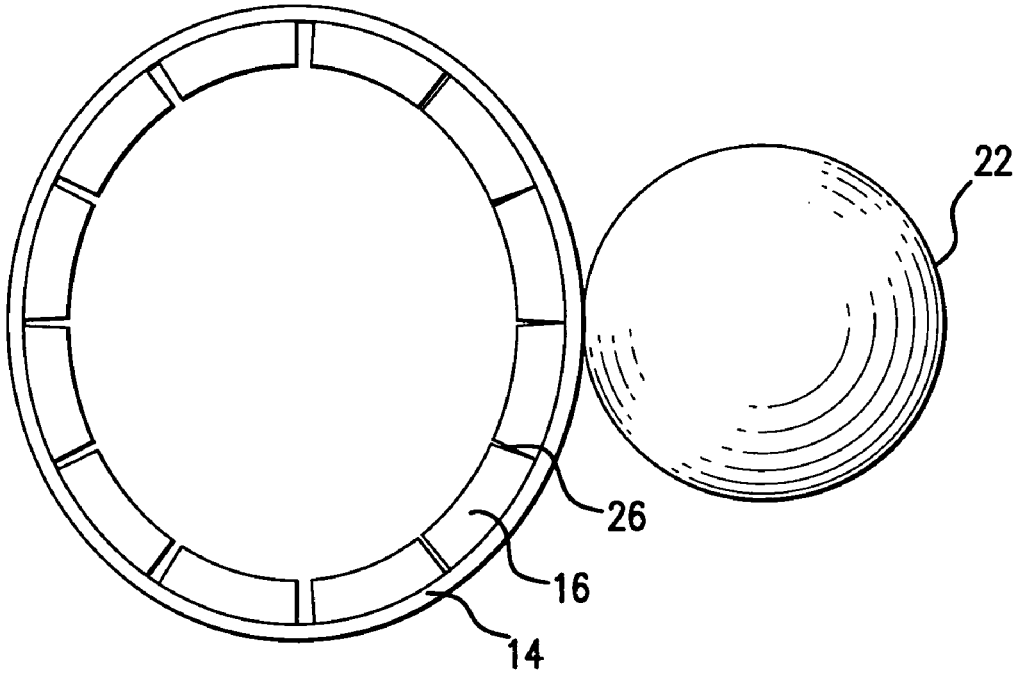
FIG. 7 is a graphical rendition of a ball hitting the bat according to the present invention at high speeds.
Figure 8:
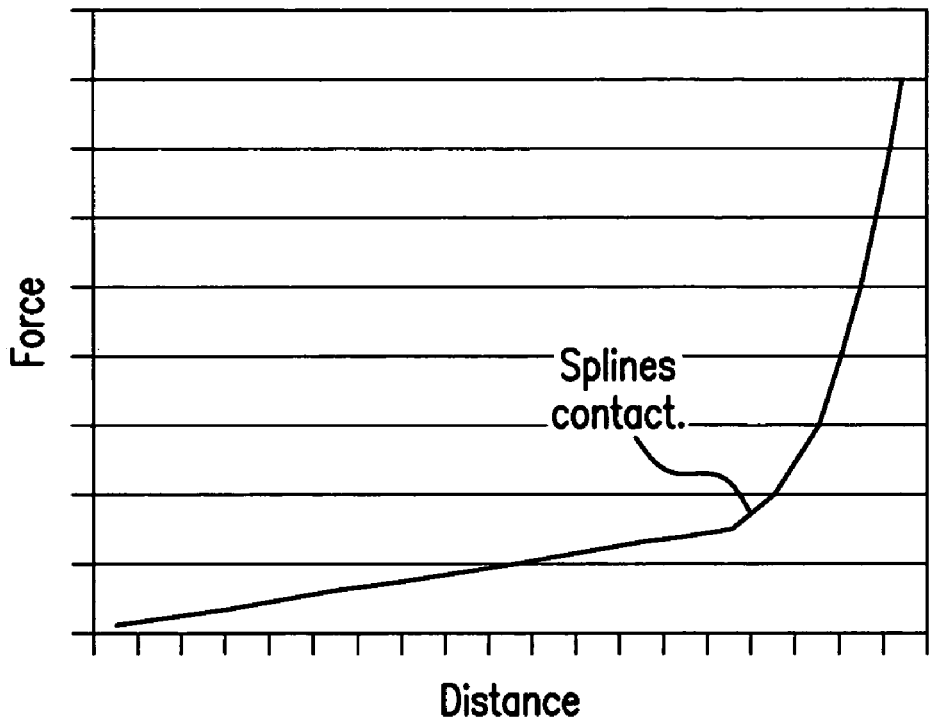
FIG. 8 is a graph illustrating the present design creating a non-linear spring constant.

As shown in FIG. 6, when a ball 22 impacts the external sleeve 14 of the bat at low speeds, the barrel would begin to slightly deform and ovalize. Close to where the ball 22 strikes the bat, the spacing 24 between each of the beams 16 would begin to narrow and the beams 16 act as narrow beam springs to help store energy from the impact. As shown in FIG. 6, the spacing 17 between the beams 16 directly opposite from where the ball 22 struck the bat, would not change in dimension. However, as the circumferential distance of the bat approaches the point of impact, the spacing 24 between the beams 16 is lessened. It is noted that, as shown in FIG. 6, at low impact speed, while the spacing between some of the beams 16 become narrow, there is no contact between adjacent beams to one another. However, as shown in FIG. 7, during a high speed impact with a ball 22, the barrel would deform to a greater degree and would reach a point where the sides of the beams close to the impact zone would contact one another such as shown at 26. It is noted that the beams 16 directly opposite from the impact point, would not touch one another. When the beams 16 do contact, the effective radial stiffness of the barrel 11 increases rather dramatically, since any additional deformation only attempts to wedge the beams more tightly together. This feature is illustrated in FIG. 8 which shows the dramatic increase of the force as the beams contact thereby creating a non-linear spring constant. The x coordinate of the graph relates to the compressive distance of the barrel and the y coordinate relates to the force of impact.

Consequently, by controlling the bending stiffness of the beams 16 and the initial gap 17 between each spline prior to any contact, a bat can be constructed that is quite flexible in the radial direction under a certain range of deformation, and then would stiffen rather dramatically to limit the maximum energy return to the ball when the beams contact each other at 26. This is analogous to an automobile suspension with a "bump stop" to avoid excess suspension travel which would result in damage to the automobile.

The use of FRP materials in bats has grown dramatically in recent years. By controlling fiber angle and ply stacking, FRP materials permit improved bat designs by allowing manufacturers to optimize the bending stiffness of the handle while separately controlling the radial stiffness of the barrel. In addition, FRP materials have a vibration-dampening coefficient much greater than materials, such as aluminum. This higher dampening coefficient benefits the player by reducing vibrations transferred to the hands and causing discomfort or "sting." Unfortunately, existing bat designs employing FRP materials have a poor record of durability.

Figure 9:
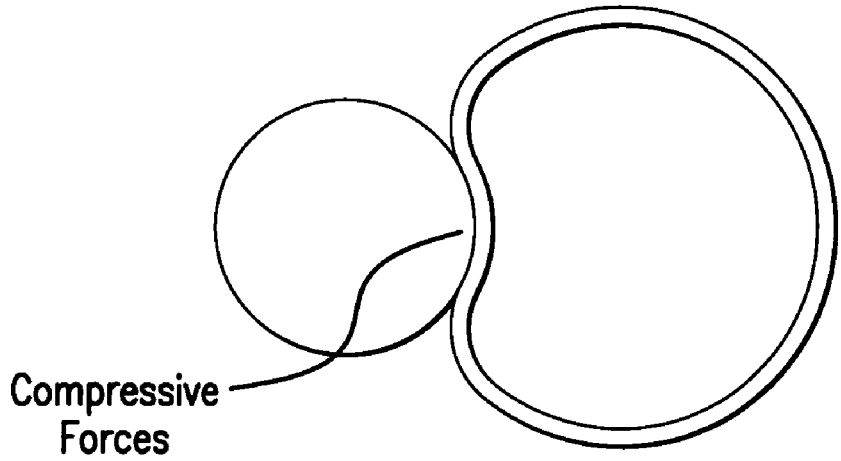
FIG. 9 illustrates a typical ball impact on prior art FRP barrel structures.

Although FRP materials are quite strong in tension relative to other materials in the direction parallel to the fibers, in compression the fibers provide little reinforcement and the strength is significantly reduced. The bat/ball collision creates localized compressive forces in the center of the impact zone as shown in FIG. 9. When FRP is configured in a round tubular structure in the bat barrel, these compressive forces result in delamination, cracking and ultimately failure. It is commonly known that existing FRP material bats begin breaking down at its first use and have a relatively limited useful life.

The design of the present invention utilizes the benefits of FRP materials with improved durability over existing bats. This durability is produced through the utilization of the narrow FRP composite beams versus the solid tubular structure of existing designs. As a result, localized compressive stresses are greatly reduced thereby attenuating impact damage and prolonging the usable life of the bat. Similarly, the design of the present invention would improve the durability of the external sleeve 14 by limiting the maximum deformation within the elastic limit of the sleeve material.

Figure 10:
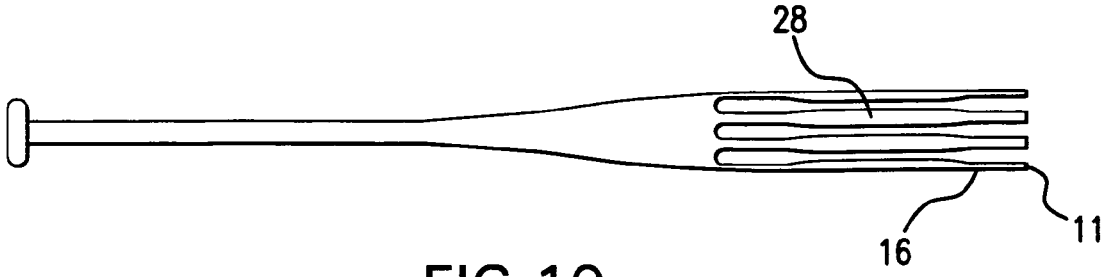
FIG. 10 is a side view of another embodiment of the present invention.
Figure 11:
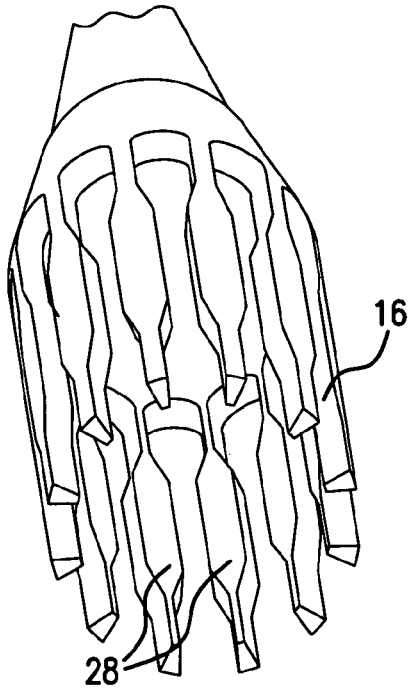
FIG. 11 is a perspective view of the embodiment shown FIG. 10.

FIGS. 10 and 11 illustrate a variation of the design of the present invention by varying the shape of the beams 16 along their length. In this example, approximately midway between the top and bottom ends of the beams 16, a relatively wide portion 28 is included. This widened portion would reduce the spacing between the beams at approximately their midpoint by increasing the width of the beams at this point at approximately this midpoint. In this variation, only the compression of the middle portion of the barrel would be limited by the side contact of the beams. Therefore, the spacing of each of the beams between one another with the exception of the middle portion would generally be greater than the spacing 17 shown in FIG. 5. At either end, the compression would not be limited by side contact. However, at either end of the spline, the radial stiffness increases due to the proximity of the taper section or the end cap provided on the end of the barrel. Thus, this combination could provide a fairly constant impact response along the length of the barrel 11, effectively widening the perceived sweet spot.

Figure 12:
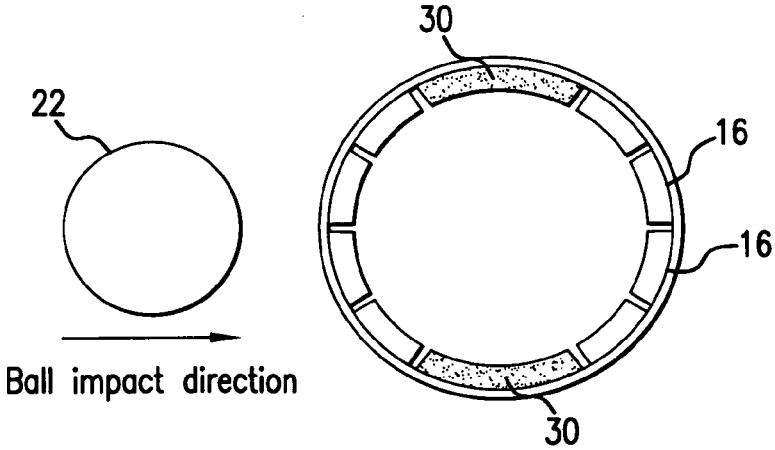
FIG. 12 is another variation of the present invention.
Figure 13:
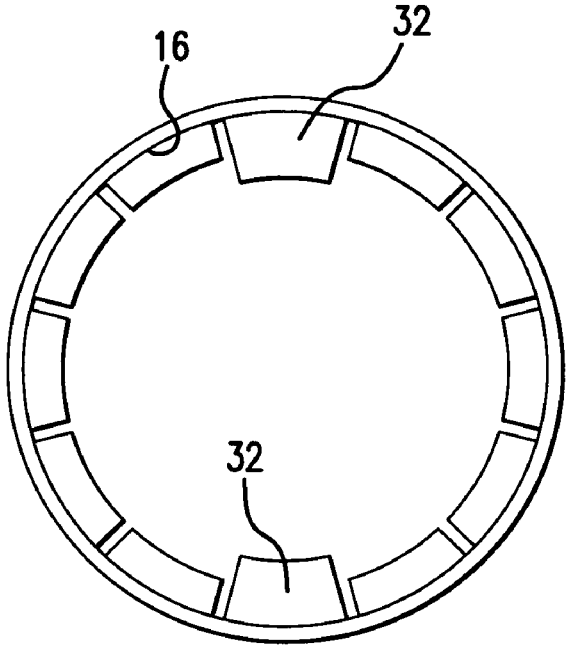
FIG. 13 shows the variation illustrated in FIG. 12 combined with the means to control hand orientation.

The embodiments shown in FIGS. 12 and 13 would also modify the geometry of the beams 16. This would result in varying the stiffness property of different beams along the circumference of the barrel. In the embodiment shown in FIG. 12, beams 30 oriented approximately 90 degrees from the point of impact from the ball 22 are made to be very stiff in bending in the direction of impact due to its increased width. Similarly, the design shown in FIG. 13 utilizes beams 32 provided 90 degrees from the desired point of impact which are thicker than the adjacent beams. Both of the embodiments shown in FIGS. 12 and 13 would increase the bending stiffness of the bat. Bats with higher overall bending stiffness have been shown to perform better than bats with lower overall bending stiffness. The beams 16 in line with the impact of the ball are designed to be more compliant for improved impact response. While the embodiments shown in FIGS. 12 and 13 illustrate various types of geometry of modification to the beams, it is understood that many different configurations are possible within the scope of the present invention.

Figure 14:
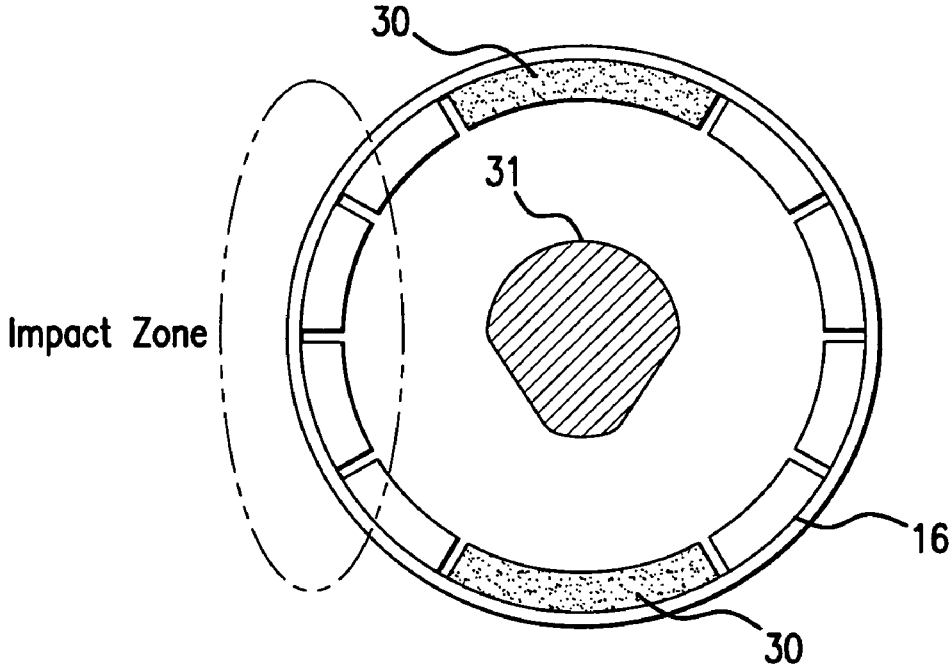
FIG. 14 is yet another variation of the present invention.

FIG. 14 illustrates the embodiment shown in FIG. 13 when combined with the teachings shown in U.S. Pat. No. 7,086,973, issued to Wells et al., having an improved handle cross-section 31, thereby creating an intended impact zone in a given region of the circumference. In these embodiments, it is important to ensure that, when hitting, the batter position the bat in his or her hand in a manner to ensure the appropriate impact zone.

Figure 15:
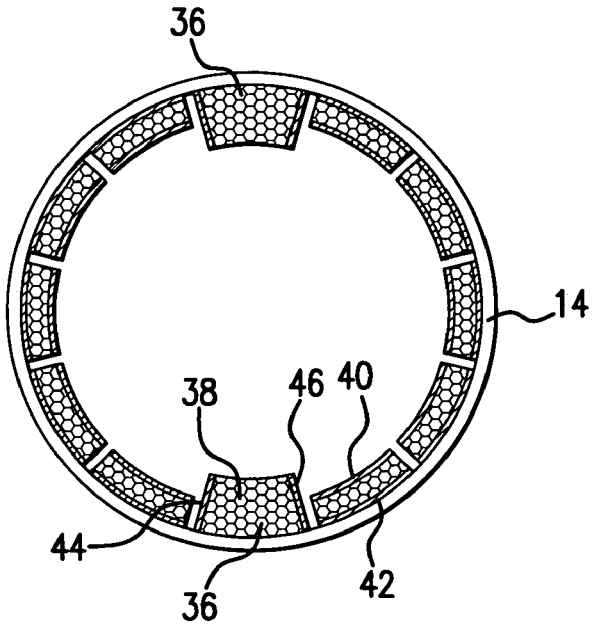
FIG. 15 is yet another variation of the present invention.

FIG. 15 shows yet another variation of the geometry and construction of the beams. Beams 36 have a thickness greater than the other beams surrounding the barrel of the bat. All of the beams use a sandwich core construction containing core layers 38 surrounded by fiber reinforced layers 40, 42 or 44, 46. The orientation of the fiber piles and the core material can be oriented about the circumference to similarly control the overall bending stiffness while maintaining the impact response of the hitting surface. The previously described external sleeve 14 designated as the shell in FIG. 15 would surround the variable core layers.

Figure 16:
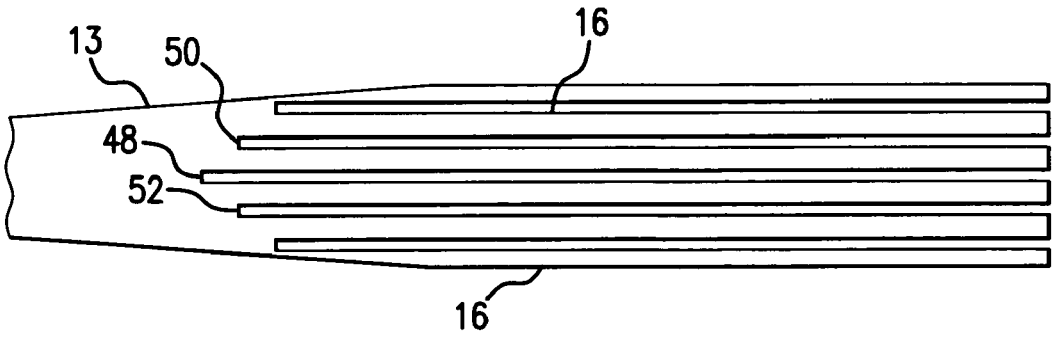
FIG. 16 is yet another modification of the beams of the present invention.
Figure 17:
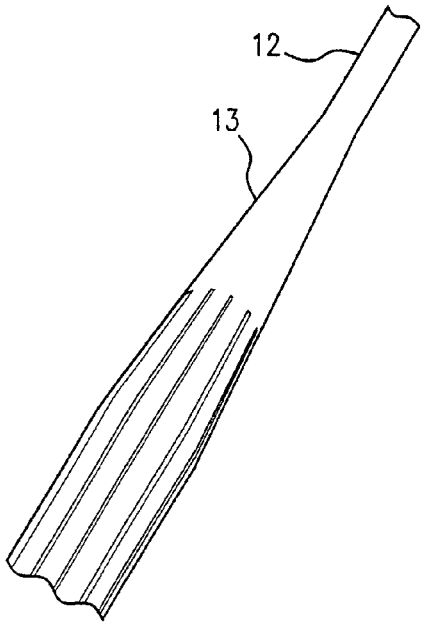
FIGS. 17-18 are views showing components used to provide a bat using the snap-fit method.
Figure 18:
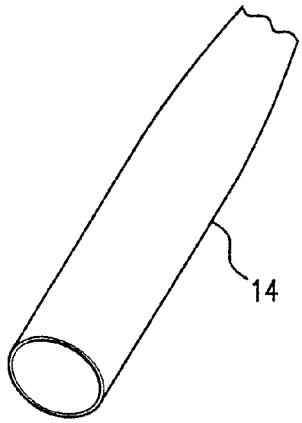

As previously indicated, the external sleeve 14 can be secured by adhesive, or by various types of mechanical attachments. However, it is noted that utilizing a mechanical attachment exclusively is preferred because it allows the beams to move independently from the sleeve and simplifies the manufacturing process by eliminating messy adhesives. FIG. 16 illustrates a manner for facilitating the mechanical attachment of the external sleeve 14 to the barrel 11. As shown in FIG. 16, beams 16 would extend from the top of the barrel to the beginning of the taper 13. However, beams 48, 50 and 52 are of a longer length than beams 16, and are provided on opposing _sides of the barrel to flex inward and accommodate a snap-fit feature. If the snap-fit feature is curved to match an opposing curve in the tapered end 19 of external sleeve 14, a system is created which locks the sleeve in place both along the length of the bat and in rotation. In the snap-fit method shown in FIGS. 16, 17 and 18, the external sleeve 14 would be directly attached to the barrel of the bat. The end cap would still be included for the purpose of closing off the end of the bat, but not for the purpose of attaching the sleeve 14 to the barrel of the bat.

Figure 19:
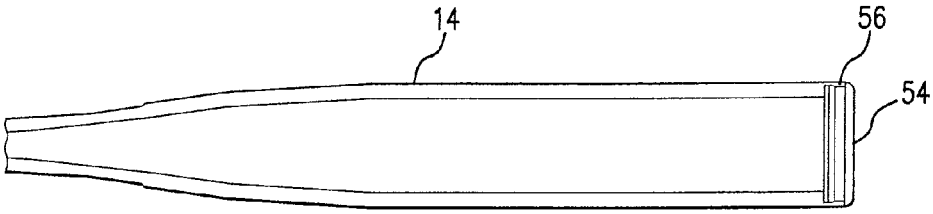
FIG.19 PRIOR ART
FIGS. 19-20 are views showing a prior art method of securing the sleeve to the barrel of the bat.
Figure 20:
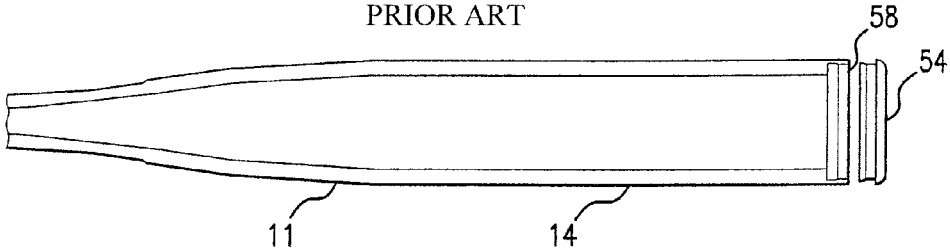
FIG.20 PRIOR ART

The prior art method of attaching the external sleeve 14 to the barrel using an end cap 54 is shown in FIGS. 19 and 20. In these figures, a gap 56 is provided between the end cap and the frame or barrel and an internal groove 58 is provided on the inside of the sleeve allowing the end cap 54 to be snapped in place over the end of the external sleeve 14. However, these designs, while attaching the end cap 54 to either the sleeve 14 or the barrel 11, they do not contribute to securing one to the other and adhesive must be employed.

Figure 21:
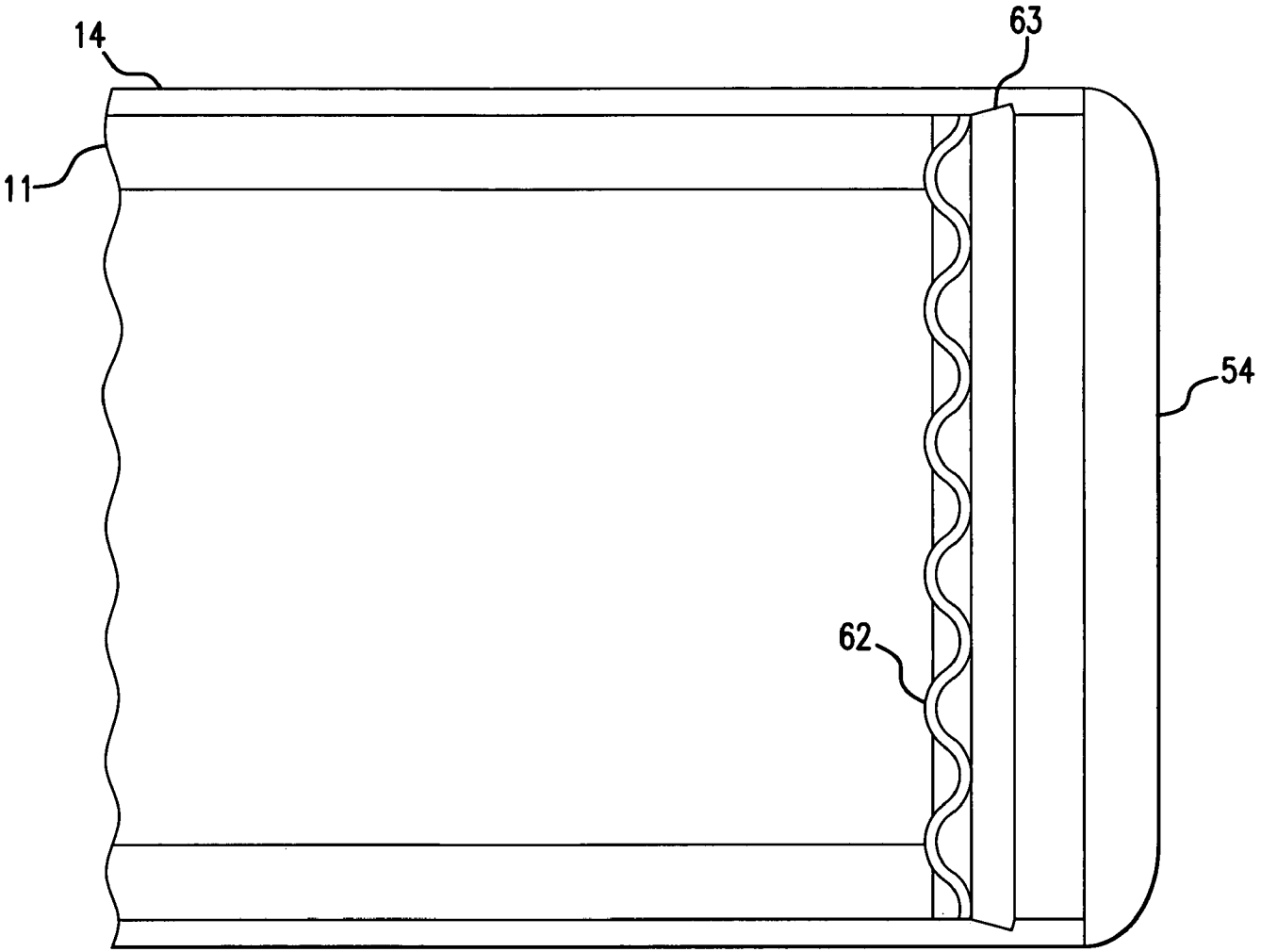
FIGS. 21 and 22 show another manner of attaching the sleeve to the barrel of the bat.
Figure 22:
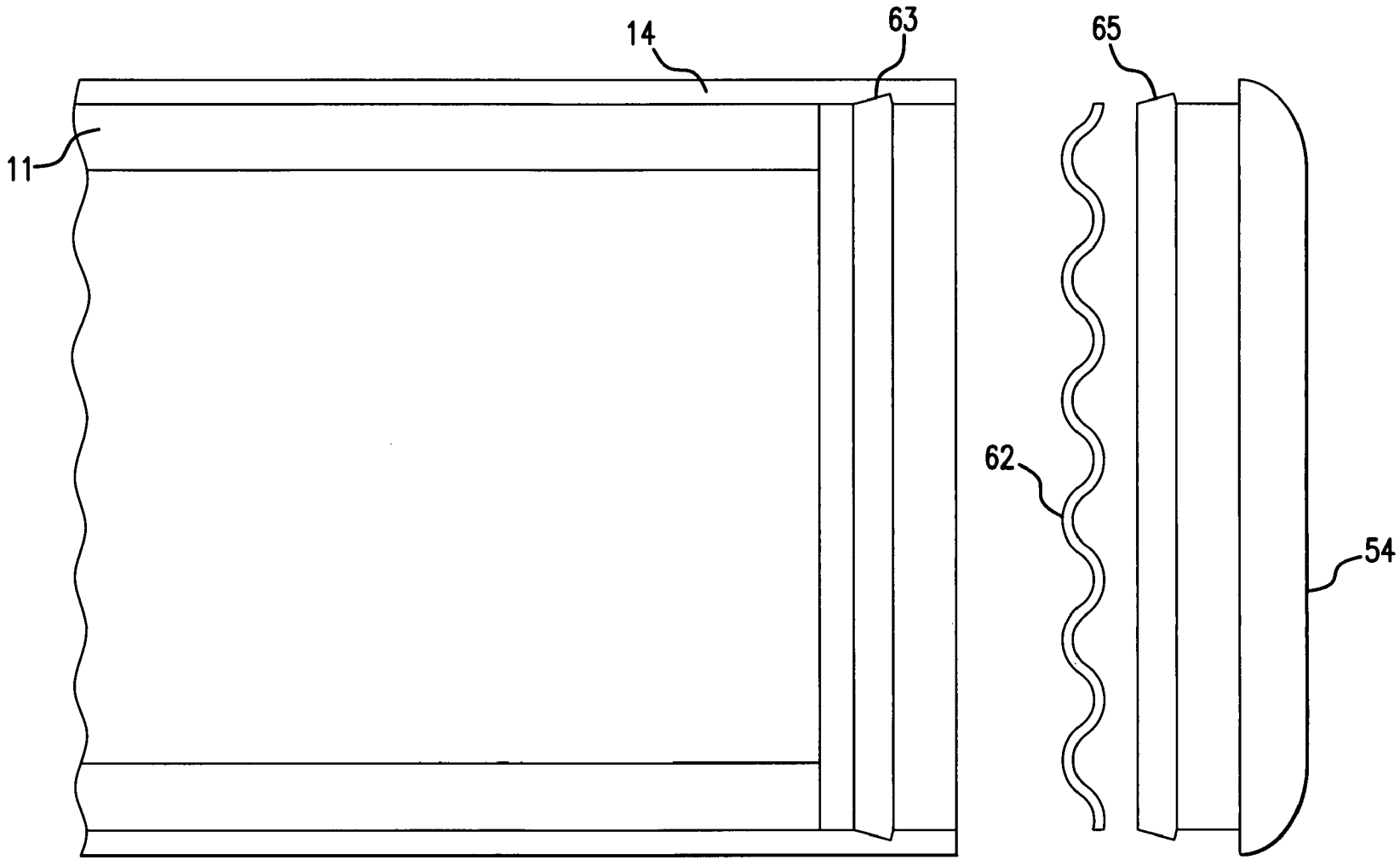
Figure 23:
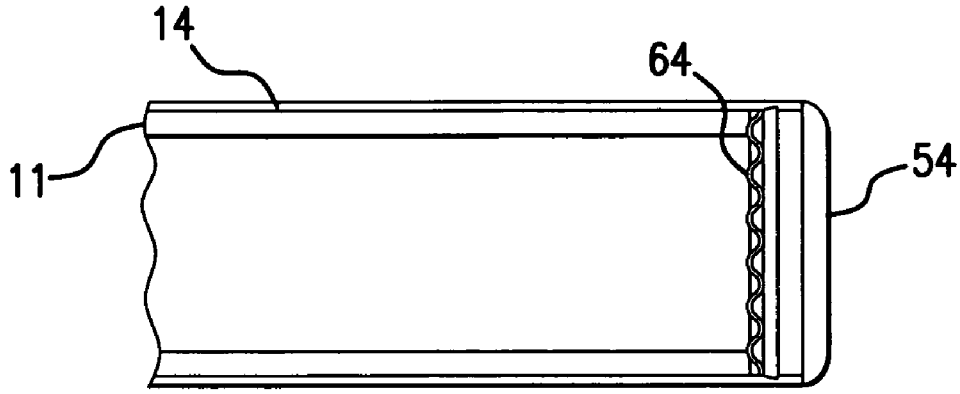
FIGS. 23 and 24 show yet another manner of attaching the sleeve to the barrel of the bat.
Figure 24:
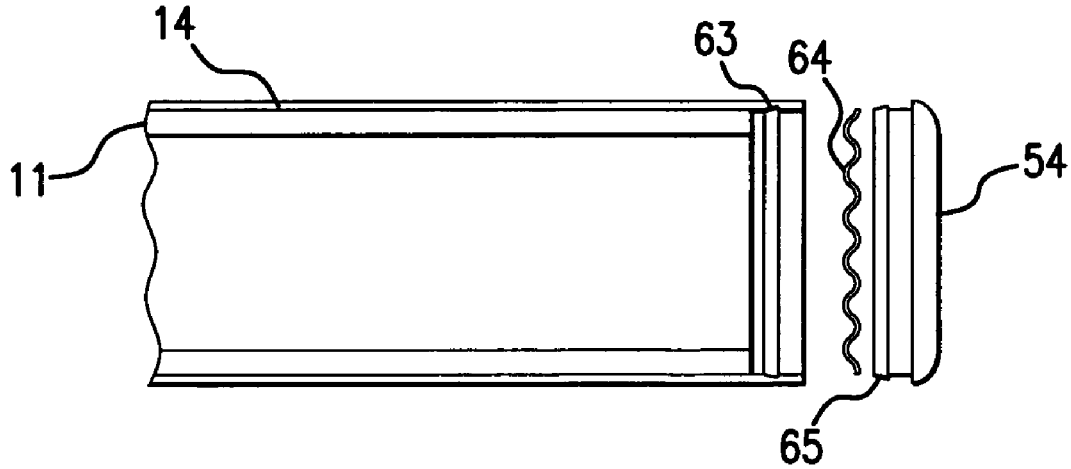

The variations shown in FIGS. 21 and 22 utilize a compressible washer 62 placed between the end cap and an internal groove 63 surrounding the frame 11. The internal groove 63 is designed to accept the bottom portion 65 circumferentially extending around the end cap 54. When in place, the compressible washer 62 would exert a force against the frame or barrel, as well as an opposing force against the end cap 54. This would result in the end cap 54 exerting a force on the sleeve 14 via the engaged snap-fit feature. These forces are countered at the tapered junction at the opposite end of the sleeve. As a result, the sleeve and the frame are secured together without the use of adhesive. The compressible ring can be constructed from an elastomeric material or, in the embodiment shown in FIGS. 23 and 24, can be a spring washer 64, which is provided between the internal groove 63 and the bottom portion 65 of the end cap as described with respect to FIGS. 21 and 22.

Figure 25:
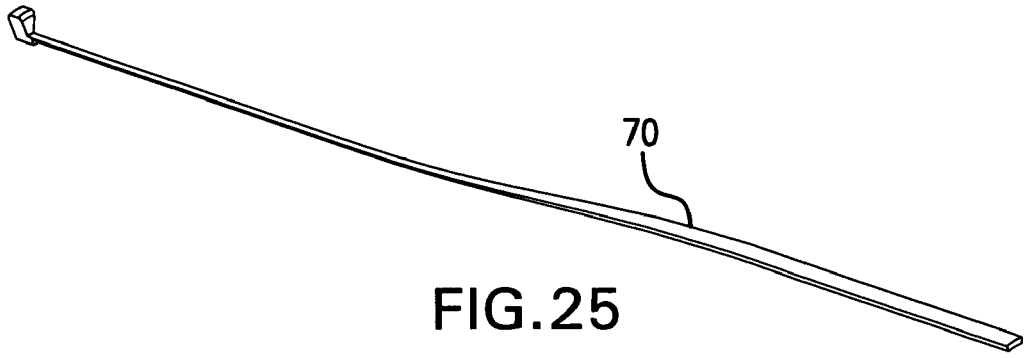
FIGS. 25-27 show an alternate method of manufacturing the bat.
Figure 26:
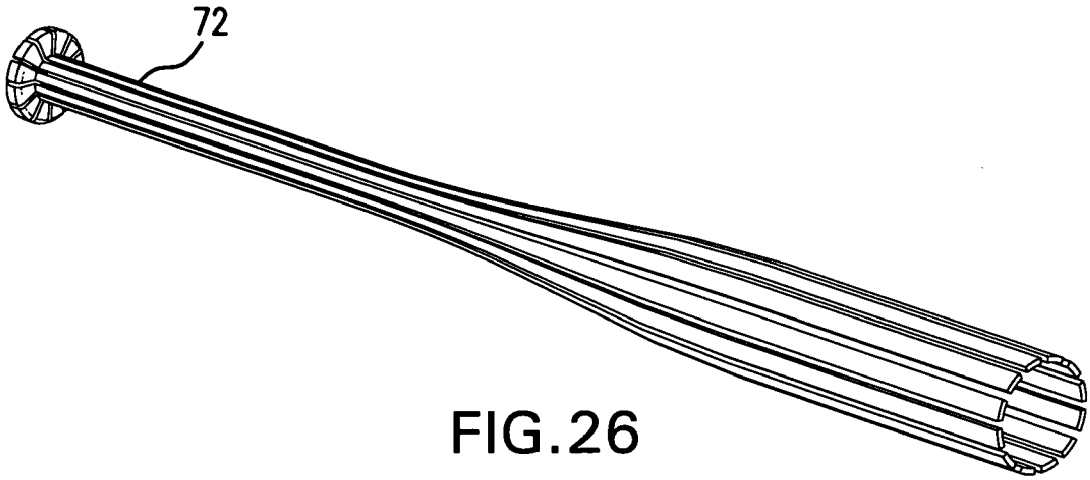
Figure 27:
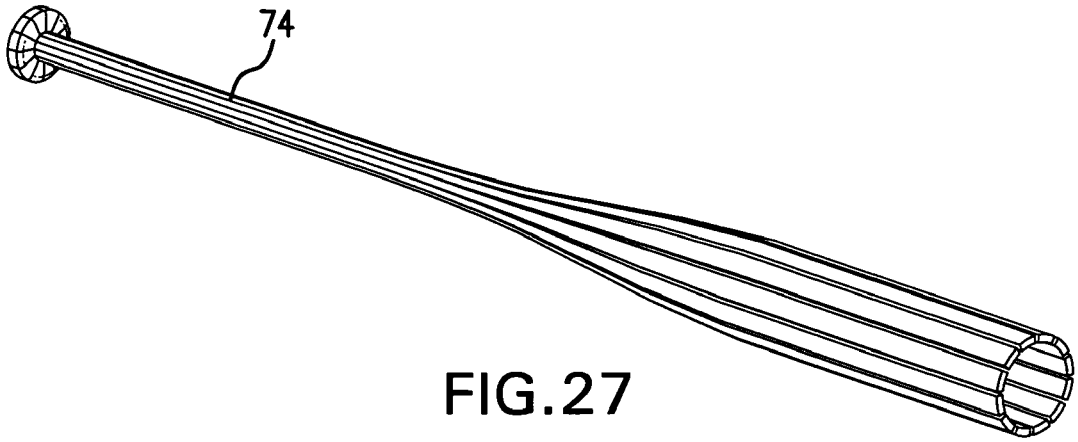

The frame of the baseball or softball bat according to the present invention can be manufactured using a multitude of methods. For example, a frame can be produced by using any combination of table rolling, RTM, vacuum bagging, bladder molding, or hand lay-up to form a structure similar to the existing one piece composite bats. This initial structure can then have material removed by sawing, routing, laser or water jet cutting or any other means of material removal to form the multiple barrel support beams 16. Alternately, the handle, taper and multiple barrel support beams can be manufactured in its final configuration via hand lay-up or vacuum bagging. An alternate method of manufacture is illustrated in FIGS. 25-27. In this embodiment, a plurality of individual composite beams 70 are assembled into the final frame shape. These beams 70 are individually bonded in the handle region 72 using a rigid adhesive or an elastomeric material to form the unitary frame shown in FIG. 27. Bonding of the individual beams using the elastomeric material could provide additional vibration dampening. Additionally, a tubular sleeve can be assembled over the handle portion to unify the multiple beams as shown by 74.

Although illustrated and described herein with reference to certain specific embodiments, the bat and methods for manufacturing the bat, are nevertheless not intended to be limited to the details shown. Rather, various modifications may be made to the details within the scope and range of equivalence of the claims without departing from the spirit of the invention.

What is claimed is:

1. A bat comprising a handle;

a tapered section connected to said handle;

a hollow barrel having a top portion and outer circumference, said hollow barrel connected to said tapered section, said hollow barrel including a plurality of longitudinal beams extending from said top portion to said tapered section, said longitudinal beams spaced around the circumference of said barrel, each of said beams separated from adjacent beams by a distance d prior to an impact between a ball and said hollow barrel; and an external sleeve secured around said outer circumference of said barrel;

wherein at low impact speeds with a ball, the spacing between a plurality of said adjacent beams would be greater than zero, but less than d, and further wherein at high impact speeds with the ball, a plurality of said beams would contact adjacent beams.

2. The bat in accordance with claim 1, wherein said plurality of longitudinal beams are constructed from fiber-reinforced plastic (FRP) material.

3. The bat in accordance with claim 2, wherein said external sleeve is metallic.

4. The bat in accordance with claim 2, wherein said external sleeve is constructed from FRP material.

5. The bat in accordance with claim 1, wherein one end of said external sleeve is tapered.

6. The bat in accordance with claim 1, wherein the width of each of said beams is constant along their length and the width of each spline is equal to one another.

7. The bat in accordance with claim 1, wherein the width of each of the beams is greater in the middle than the width at each of its ends.

8. The bat in accordance with claim 1, wherein the width of two beams, provided on opposite sides of said hollow barrel, is greater than the width of the remaining beams.

9. The bat in accordance with claim 1, wherein the thickness of two beams, provided on opposite sides of said hollow barrel, is greater than the thickness of the remaining beams.

10. The bat in accordance with claim 1, further including an end cap and a compressible washer, said external sleeve provided with an internal groove, wherein said external sleeve is attached and surrounds said barrel by snap fitting said end cap onto said external sleeve while said compressible washer is provided within said internal groove.

11. The bat in accordance with claim 10, wherein at least one of said beams extends into said tapered section.

* * * * *